US006752493B2

(12) United States Patent
Dowell et al.

(10) Patent No.: US 6,752,493 B2
(45) Date of Patent: Jun. 22, 2004

(54) FLUID DELIVERY TECHNIQUES WITH IMPROVED RELIABILITY

(75) Inventors: Daniel D. Dowell, Albany, OR (US); Louis C. Barinaga, Salem, OR (US); Ashley E. Childs, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/136,706

(22) Filed: Apr. 30, 2002

(65) Prior Publication Data

US 2003/0202073 A1 Oct. 30, 2003

(51) Int. Cl.[7] ..... B41J 2/98
(52) U.S. Cl. ..... 347/89; 347/87
(58) Field of Search ..... 347/85, 86, 87, 347/89, 92

(56) References Cited

U.S. PATENT DOCUMENTS

| | | | |
|---|---|---|---|
| 5,751,300 A | 5/1998 | Cowger et al. | 347/6 |
| 5,847,736 A | 12/1998 | Kanbayashi et al. | 347/89 |
| 5,936,650 A | 8/1999 | Ouchida et al. | 347/89 |
| 6,196,651 B1 | 3/2001 | Zuber et al. | 347/7 |
| 6,352,331 B1 | 3/2002 | Armijo et al. | 347/19 |

FOREIGN PATENT DOCUMENTS

| | | |
|---|---|---|
| EP | 0965452 A1 | 12/1999 |
| EP | 0967083 A2 | 12/1999 |

*Primary Examiner*—Anh T. N. Vo

(57) ABSTRACT

Techniques for improving reliability of print cartridges that employ a fluid recirculation path within the cartridges. One reliability feature is provided by active heat management, wherein the recirculation path is employed to provide printhead cooling. Another feature is an in-printer printhead and standpipe priming technique. Idle time tolerance can also be improved, with the ability to re-circulate ink and purge air, to provide a mode of operation that can improve the reliability of the print cartridge during idle times. A "cleaning fluid" can be introduced that could break-up the sludge as it circulates through the print cartridge. Improved particle filtering is provided, through fluid recirculating through the system, passing through the standpipe or plenum area and across the backside of the printhead. As the fluid moves through this region, particles trapped in the standpipe get swept out of the area and eventually through a filter before reaching the printhead again.

29 Claims, 11 Drawing Sheets

FIG. 5
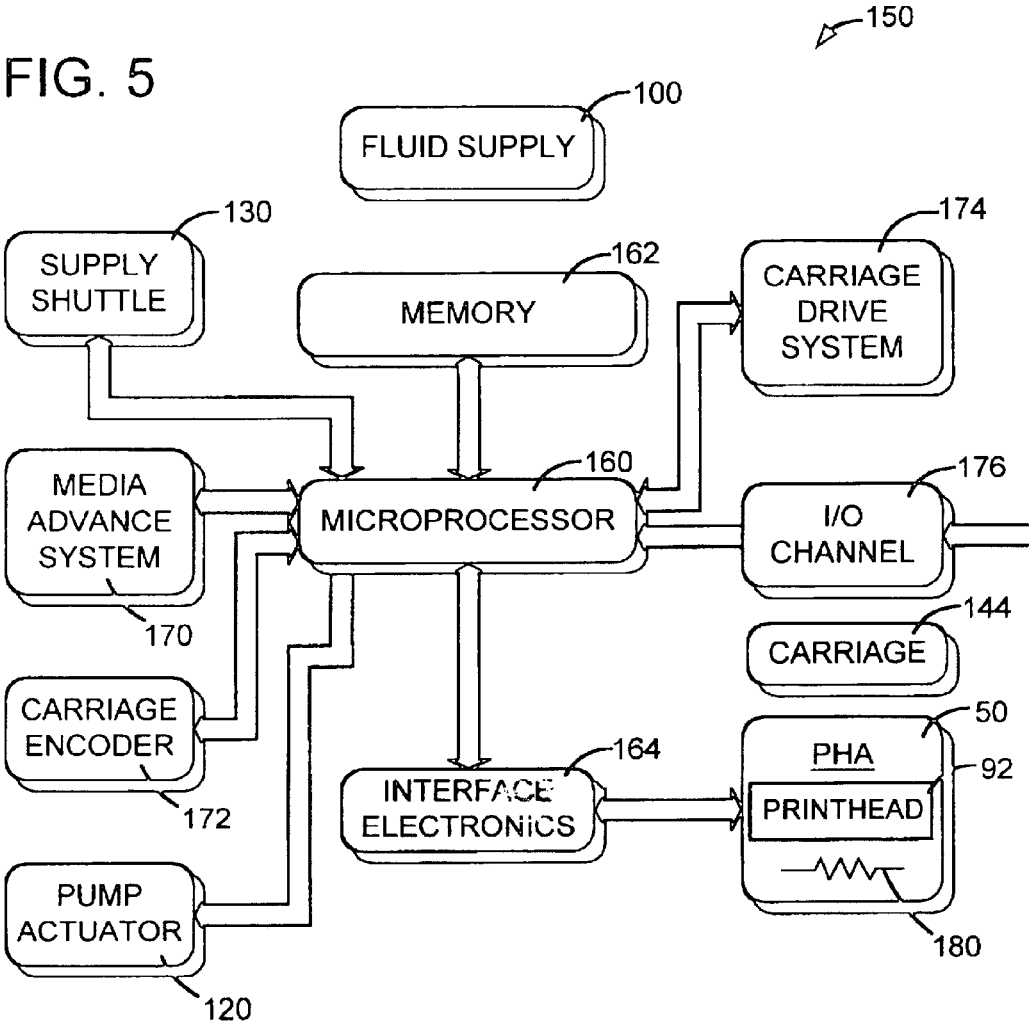
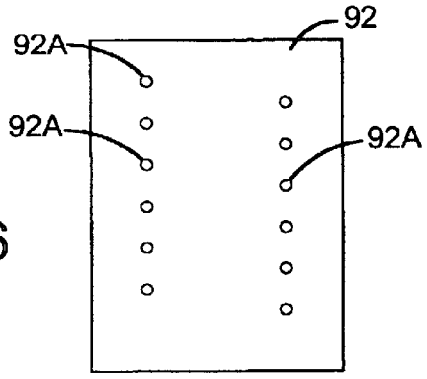
FIG. 6

370

372
START
374
PRINT
376
ANY NOZZLES MISSING ?
NO
378
CONTINUE TO PRINT?
NO
YES
380
CAPPING
382
END
384
WET BLADE WIPE
386
IDLE DISCHARGE
387
BLADE WIPE
388
TEST PRINT
390
ANY NOZZLES MISSING ?
NO
YES
391
MAX ATTEMPTS?
YES
460
FINAL RECOVERY
NO
392
WET BLADE WIPE
393
MOVE TO PUMP POSITION
394
RECIRCULATION PRIME

FLUID DELIVERY TECHNIQUES WITH IMPROVED RELIABILITY

BACKGROUND OF THE DISCLOSURE

Inkjet printing systems are in common use today. In one common form for swath printing, the printing systems includes one or more print cartridges mounted on a scanning carriage for movement along a swath axis over a print medium at a print zone. The print medium is incrementally advanced through the print zone during a print job.

There are various print cartridge configurations. One configuration is that of a disposable print cartridge, typically including a self-contained ink or fluid reservoir and a printhead. Once the fluid reservoir is depleted, the print cartridge is replaced with a fresh cartridge. Another configuration is that of a permanent or semi-permanent print cartridge, wherein an internal fluid reservoir is intermittently or continuously refilled with fluid supplied from an auxiliary fluid supply. The auxiliary supply can be mounted on the carriage with the print cartridge, or mounted off the carriage in what is commonly referred to as an "off-axis" or "off-carriage" system.

It is standard procedure to ship ink jet print cartridges "wet," meaning full of ink. Ink exposure over time can compromise the structural and electrical integrity of the print cartridges. Print cartridges may spend a significant time in the shipping channels or on a merchandiser's shelf before it is purchased. During this time, the print cartridges are constantly under chemical attack. In some cases, this attack could result in a print cartridge that is not operative when the customer installs it in their printer. This problem is compounded even further in systems that allow the customer to replace the ink supply without replacing the printhead. The desired printhead life in this type of system is 3 to 5 years, which includes a shelf life up to 18 months. If print cartridges could be shipped "dry," the shelf life would increase and the ink exposure would not start until the print cartridge is purchased and put in use. This would require a printer that can prime the standpipe and nozzles after installation.

Air accumulation and excessive heating of the printhead can also result in a shorter life for print cartridges. The printing systems do not have the means of dealing with these problems actively. Instead air is warehoused inside the print cartridge, which in the absence of any other failure mode will eventually result in printhead starvation, and heat is dealt with by slowing the printer down when temperatures reach unacceptable levels.

Another problem that can lower the reliability of printing systems is excessive idle time. One problem associated with idle time occurs when large particles within the pigmented inks settle on the backside of the printhead and block ink flow. A second problem associated with idle time is water loss. If the ink loses enough water during idle times, sludge can develop in the print cartridge and lead to failure. The ink will sludge faster if it sits in a small ink channel, separated from a larger reservoir.

Standpipe particles can produce print quality failures during assembly, which ultimately increases the cost of manufacturing. A flushing routine can be used in an attempt to remove particles from the standpipe prior to attaching the printhead. This approach is not 100% effective.

SUMMARY OF THE DISCLOSURE

Embodiments of this invention provide several reliability features that employ a recirculation path within a print cartridge, wherein fluid is recirculated within the print cartridge. One reliability feature is provided by active heat management, wherein the recirculation path is employed to provide printhead cooling. Another feature that can be provided is a self-priming print cartridge. Idle time tolerance can also be improved, with the ability to re-circulate ink and purge air, to provide a mode of operation that can improve the reliability of the print cartridge during idle times. A "cleaning fluid" can be introduced that could breakup the sludge as it circulates through the print cartridge. After several circulation cycles, the fluid is "spit" into a service station or printed onto paper. A further reliability improvement is provided through improved particle filtering. Each time a fluid is re-circulated through the system, it passes through the standpipe or plenum area and across the backside of the printhead. As the fluid moves through this region, particles that are trapped in the standpipe get swept out of the area and into a common chamber. From here, the fluid passes through a filter before it reaches the printhead again and any particles within the system are filtered out.

BRIEF DESCRIPTION OF THE DRAWING

These and other features and advantages of the present invention will become more apparent from the following detailed description of an exemplary embodiment thereof, as illustrated in the accompanying drawings, in which:

FIG. 5 is a schematic diagram showing further pertinent components of the exemplary printing system of FIG. 4.

FIG. 6 shows an exemplary layout of nozzles in one example of the printhead comprising the PHA of FIG. 1.

DETAILED DESCRIPTION OF THE DISCLOSURE

Overview

Figure 1:
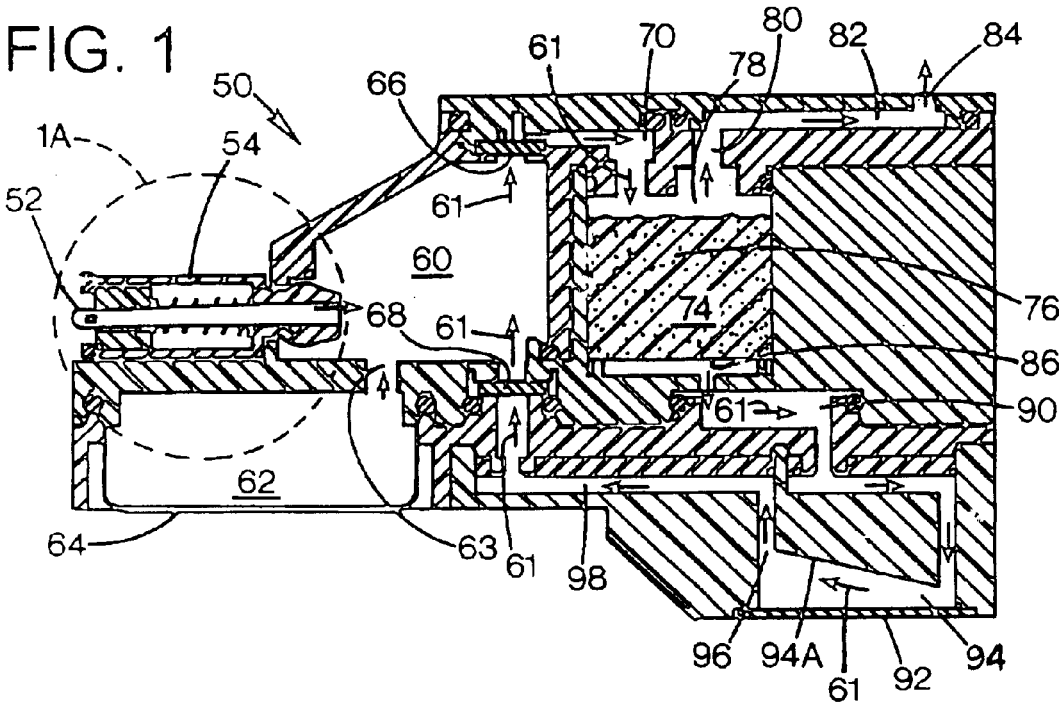
FIG. 1 is a diagrammatic cross sectional diagram of an embodiment of a print head assembly (PHA) unit comprising an exemplary "take-a-sip" fluid delivery system in accordance with aspects of the invention.

Embodiments of this invention provide several reliability features that are tied to the use of a recirculation path within a print cartridge. One reliability feature is provided by active heat management. The recirculation path is employed to provide printhead cooling. The print cartridge includes a pump structure that can be actuated, e.g., at the end of each scan across the page, or as indicated by a temperature sensor, which will pass ink from a larger reservoir across the backside of the printhead. This action can lower the temperature of the printhead through forced convection heat transfer. Improving the temperature control of the printhead reduces or eliminates the failure modes associated with excessive heat and allows the print cartridge to print without slowing down.

Another feature that can be provided in accordance with an aspect of the invention is a self-priming print cartridge. This print cartridge can be shipped from the manufacturer without printing fluid, which is ink in an exemplary embodiment. In this case, the print cartridge may have regions selectively wetted with a low vapor loss shipping fluid, such as glycerin. The wetted regions can include the filters, check valves and possibly the printhead nozzles. In another embodiment, printing fluid can be filled into certain regions, such as a free fluid chamber and a capillary member, while the filters, check valves and printhead nozzles are shipped free of the printing fluid. Actuating the pump structure after installation in a printing system brings fluid from the ink supply into the print cartridge and eliminates any air that exists. The recirculation path passes through the standpipe and across the backside of the printhead, thus priming becomes possible. Shipping the print cartridge without the printing fluid or with lessened amounts of the printing fluid will delay printing fluid exposure until the printhead is purchased and put to use, which will improve overall reliability.

Idle time tolerance can also be improved. Having the ability to recirculate ink, when the fluid supply is not attached, provides a mode of operation that can improve the reliability of the print cartridge during idle times. Excessive water loss from stagnant fluid paths can cause sludge to develop in the fluid channels. By periodically recirculating the fluid through the system, ink from the small fluid channels is returned to a larger reservoir before the water loss reaches a point where sludge develops.

Recirculation requires power to the printer. If a printer was stored without power for an extended duration, there could be a situation where sludge develops. A "cleaning fluid" can be introduced that could break-up the sludge as it circulates through the print cartridge. After several circulation cycles, the fluid could be "spit" into a service station or printed onto paper. This process would be followed with fresh fluid introduction from the supply.

A further reliability improvement is provided through improved particle filtering. Particles are often trapped in the print cartridge standpipe during assembly. These particles may lead to print quality ("PQ") failures in the factory or eventually lead to PQ failure when the print cartridge is in use. In accordance with another aspect, each time a fluid (ink or otherwise) is re-circulated through the system, it passes through the standpipe and across the backside of the printhead. As the fluid moves through this region, particles that are trapped in the standpipe get swept out of the area and into a common chamber. From here, the fluid must pass through the standpipe filter before it reaches the printhead again and any particles within the system are filtered out. This design also enables the introduction of a flushing fluid during manufacturing that can be used in conjunction with the recirculation path to remove particles from the standpipe.

These reliability techniques will be described in further detail below, after a description of exemplary print cartridges with recirculating fluid paths.

Embodiments of Print Cartridges with Recirculating Fluid Paths

An exemplary embodiment of a print cartridge with a recirculating fluid path is an intermittently refillable off axis inkjet printing system, sometimes described as a "take-a-sip" (TAS) fluid delivery system (IDS). This TAS system does not require tubes to supply fluid from an off-carriage fluid supply to the print head. Rather, the system includes an onboard fluid reservoir that provides fluid to the print head during the print cycle. This fluid reservoir is intermittently recharged via a fluidic coupling between the print head and the off-carriage supply.

A cross sectional diagram of a print head assembly (PHA) 50 comprising an exemplary TAS IDS is shown in FIG. 1. A needle septum fluidic interconnect 52 defines the entry point for fluid into the PHA. The needle is insert molded into a rigid plastic part 54 that protrudes into a free fluid chamber 60, the common chamber. Below this chamber, and in direct fluidic communication through a small aperture 63, is a diaphragm pump chamber 62 of a diaphragm pump 64.

Figure 1A:
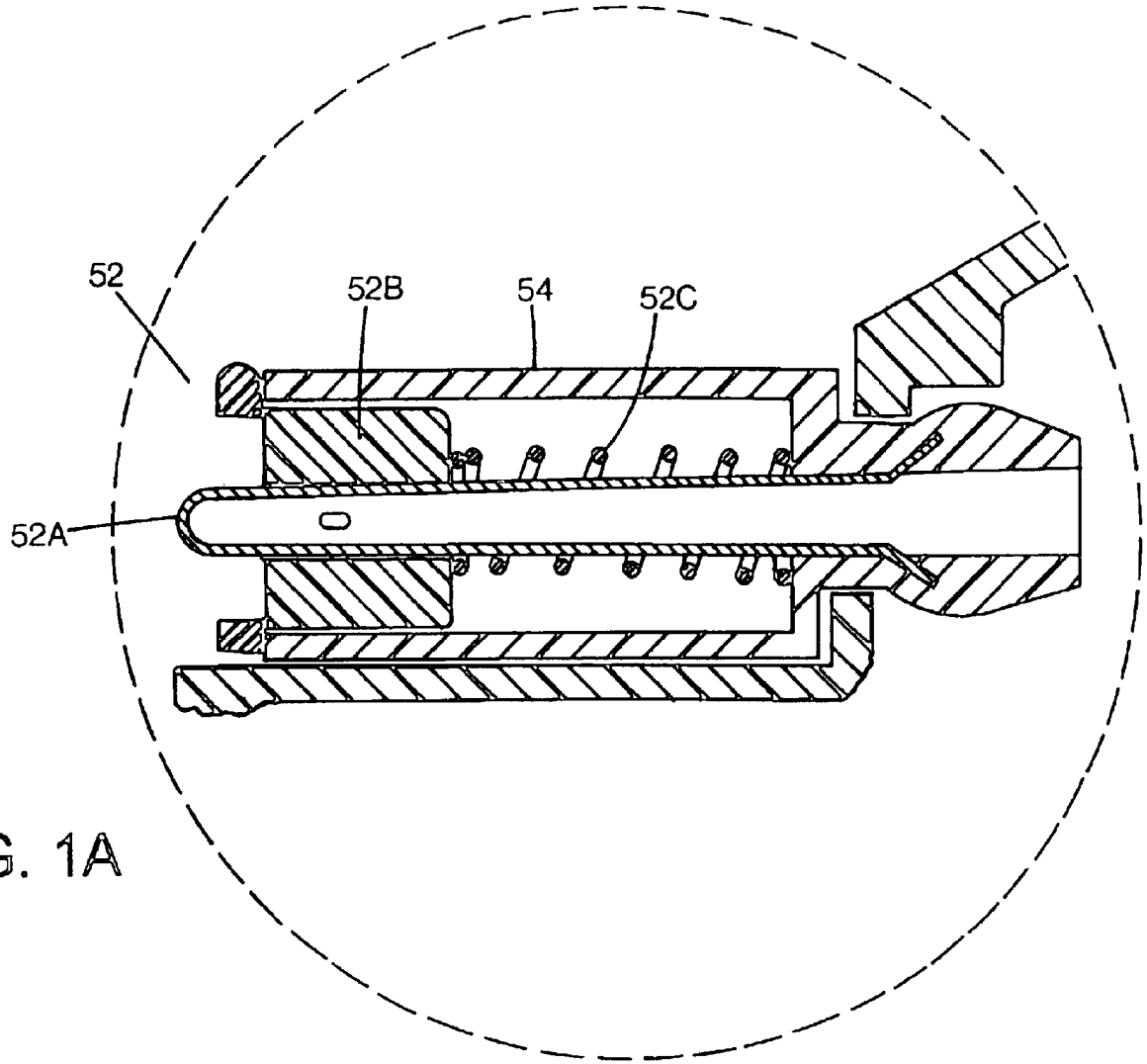
FIG. 1A shows an enlarged view of an exemplary embodiment of the fluid interconnect of the PHA of FIG. 1, with some features omitted for clarity.

FIG. 1A shows the exemplary embodiment of the interconnect 52 in enlarged view, with some features omitted for clarity. The interconnect includes a hollow needle 52A with an opening near its distal end, through which fluid can pass when connected to a mating interconnect. A sliding seal 52B fits about the distal end of the needle, within the part 54, and is biased to the closed position (shown in FIG. 1A) by a spring 52C. In the closed position, the sliding seal covers and seals the needle opening. In the open position, the seal is slid back into part 54, exposing the needle opening, and allowing fluid to be admitted into the hollow needle.

A one-way inlet valve 66, also called a check valve, is positioned at the top of the common chamber 60. The inlet valve is oriented to allow fluid flow out of the common chamber, and to resist fluid flow into the chamber.

Another check valve 68, the recirculation valve, is positioned directly below the inlet valve on the bottom face of the chamber 60. The recirculation valve is oriented to allow fluid flow into the common chamber 60, and to resist fluid flow out of the chamber.

A horizontal fluid channel 70 above the inlet valve 66 connects the valve to a chamber 74 via an aperture in the top of the chamber. A body of capillary material 76 is disposed in the chamber 74, sometimes called the capillary chamber. The capillary material 76 could be made from various materials including foam or glass beads. A small volume 78 of empty space exists at the top of the capillary material.

A second aperture 80 exists on the top face of the capillary chamber 74. This opening connects the top of the capillary chamber to a small channel 82 that leads to a labyrinth vent 84. This labyrinth vent impedes vapor transmission from the capillary chamber to the outside atmosphere.

At the bottom of the capillary chamber 74, an ultra fine standpipe filter 86 is staked. This filter functions as the primary filtration device for the system.

Below the filter 86, a small fluid inlet channel 90 creates a fluidic connection between the bottom of the stand pipe filter and the top surface of the print head 92, which includes a nozzle array, typically defined as a plurality of orifices in an orifice or nozzle plate. This channel 90 connects to the front of the die pocket, forming a fluid plenum 94. The top surface 94A of the PHA body defining the fluid plenum ramps upwardly, to direct air bubbles upwardly. A second aperture 96, referred to as the outlet, is positioned at the back of the plenum 94. A fluid channel 98, the recirculation channel, connects the outlet 96 to the bottom of the recirculation valve 68.

In this exemplary embodiment, the fluid is a liquid ink during normal printing operations. The fluid can alternatively be a cleaning fluid during a maintenance operation, a make-up fluid or the like. The printhead can be any of a variety of types of fluid ejection structures, e.g. a thermal inkjet printhead, or a piezoelectric printhead.

The recirculation channel 98 completes a fluid circuit (represented by arrow 61) that allows fluid to flow from the common chamber 60, the capillary chamber 74, through the fluid plenum 94, and return to the common chamber 60, given proper pressure gradients through the check valves 66, 68.

Figure 2:
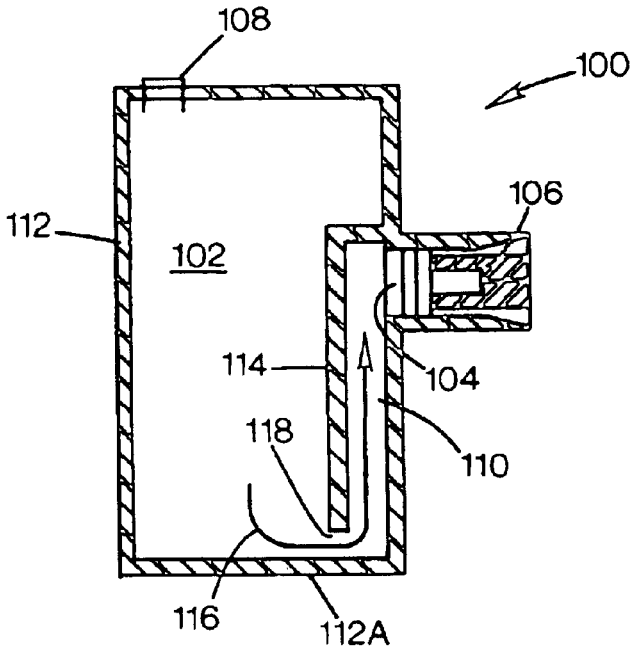
FIG. 2 is a diagrammatic cross-sectional diagram of an embodiment of an exemplary fluid supply which can be connected to the PHA of FIG. 1 for fluid replenishment.

Another part of this embodiment of a TAS system is a free fluid supply 100. As shown in FIG. 2, this embodiment of the supply includes a free fluid chamber 102, check valve 104, fluidic interconnect 106, and a vent 108 which is normally closed, and only open during replenishment. At all other times, the vent is closed. This type of vent action is implemented to prevent fluid leakage if the supply is oriented so that the fluid comes into contact with the vent feature. In one embodiment, the vent 108 is an active vent, e.g. a valve actuated by a printer motion to open (such as a valve driven by a gear slaved to an insertion or printer motion, or a valve actuated by a cam or cam surface). Alternatively, a passive vent can be employed, such as a ball bubble valve, or a check valve (driven by a pressure gradient).

The check valve 104 can alternatively be placed in the PHA 50, e.g. in a fluid path at the PHA fluid interconnect as it enters the free fluid chamber 60. In this case, the interconnect 106 of the fluid supply 100 is a type which seals when disconnected from the PHA. Placing the function of the check valve 104 in the PHA can lead to reduced cost, since the fluid supply 100 may be replaced many times over the life of the PHA.

In this embodiment, a snorkel 110 is defined by wall 114 which approaches the bottom wall 112A of the housing 112, leaving an opening 118 through which fluid can flow from chamber 102 along a path indicated by arrow 116 to check valve 104. The snorkel ensures complete or virtually complete depletion of the fluid within the chamber 102.

An event-based description of operation communicates the function of the IDS comprising PHA 50 and supply 100. For clarity, actual pressure values will be omitted and instead reference will be made to high, medium, target, and low back pressure states. The term "back pressure" denotes vacuum pressure, or negative gage pressure.

At the time of manufacture, the PHA 50 is assembled and, in one embodiment, fluid is injected into the assembly until the diaphragm pump chamber, common chamber, plenum, recirculation channel, and inlet channel are full. Fluid is injected into the capillary material until the proper back pressure for print head operation is reached.

During printing, the IDS behaves similarly to a foam based IDS design as used in conventional disposable cartridges. Ejection of drops out of the nozzles of the print head 92 causes the back pressure to build in the standpipe region, i.e. the region below the filter and the recirculation check valve. The recirculation valve 68 prevents flow from the common chamber 60 into the plenum 94. The back pressure buildup causes fluid to be drawn from the capillary material 76, through the stand pipe filter 86, and into the plenum 94. This fluid transfer depletes the capillary material, causing dynamic negative or back pressure to build in the standpipe region.

Figure 3:
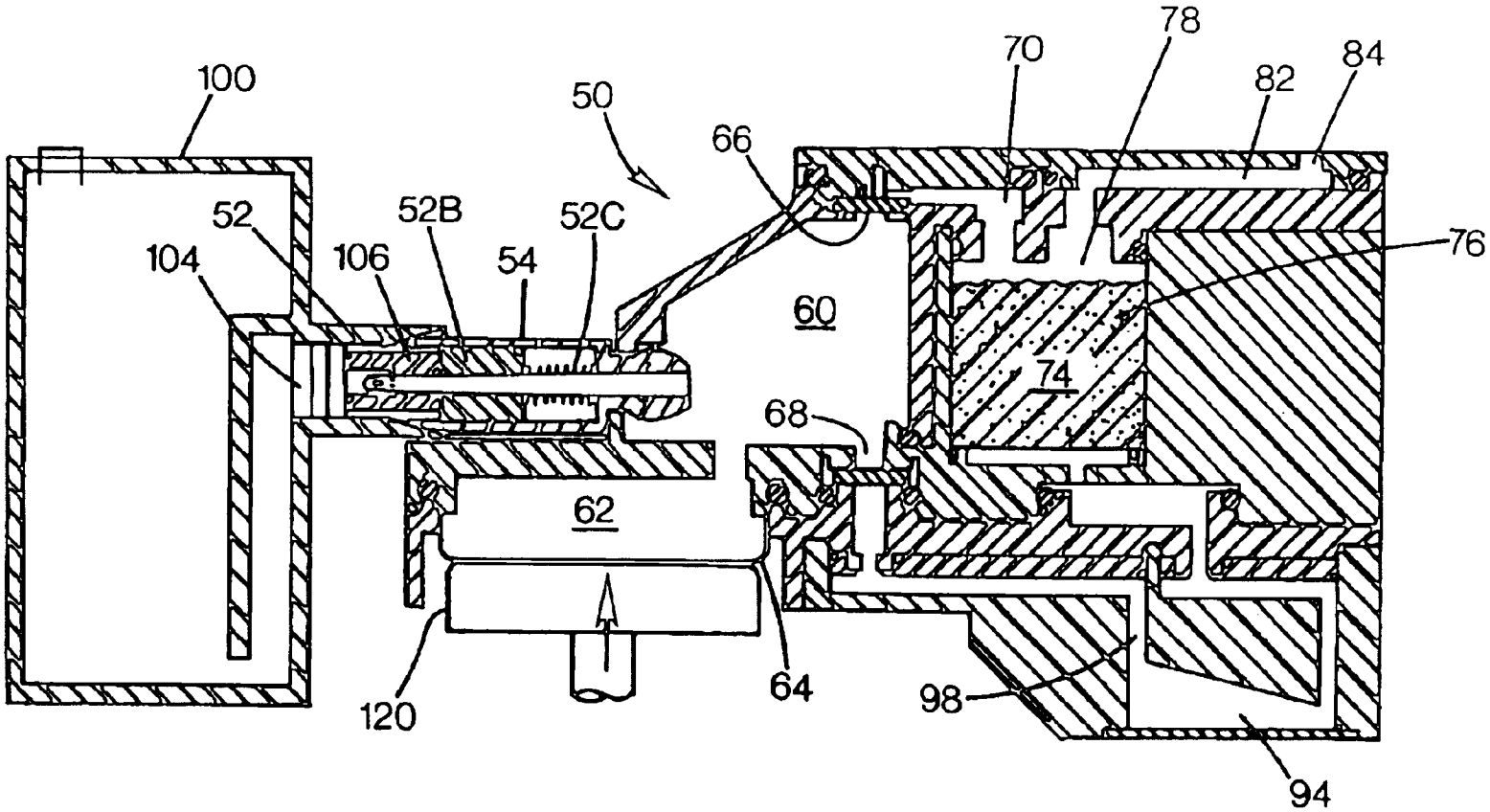
FIG. 3 is a diagrammatic cross-section diagram showing the PHA of FIG. 1 and the fluid supply of FIG. 2 in a connected relationship.
Figure 4:
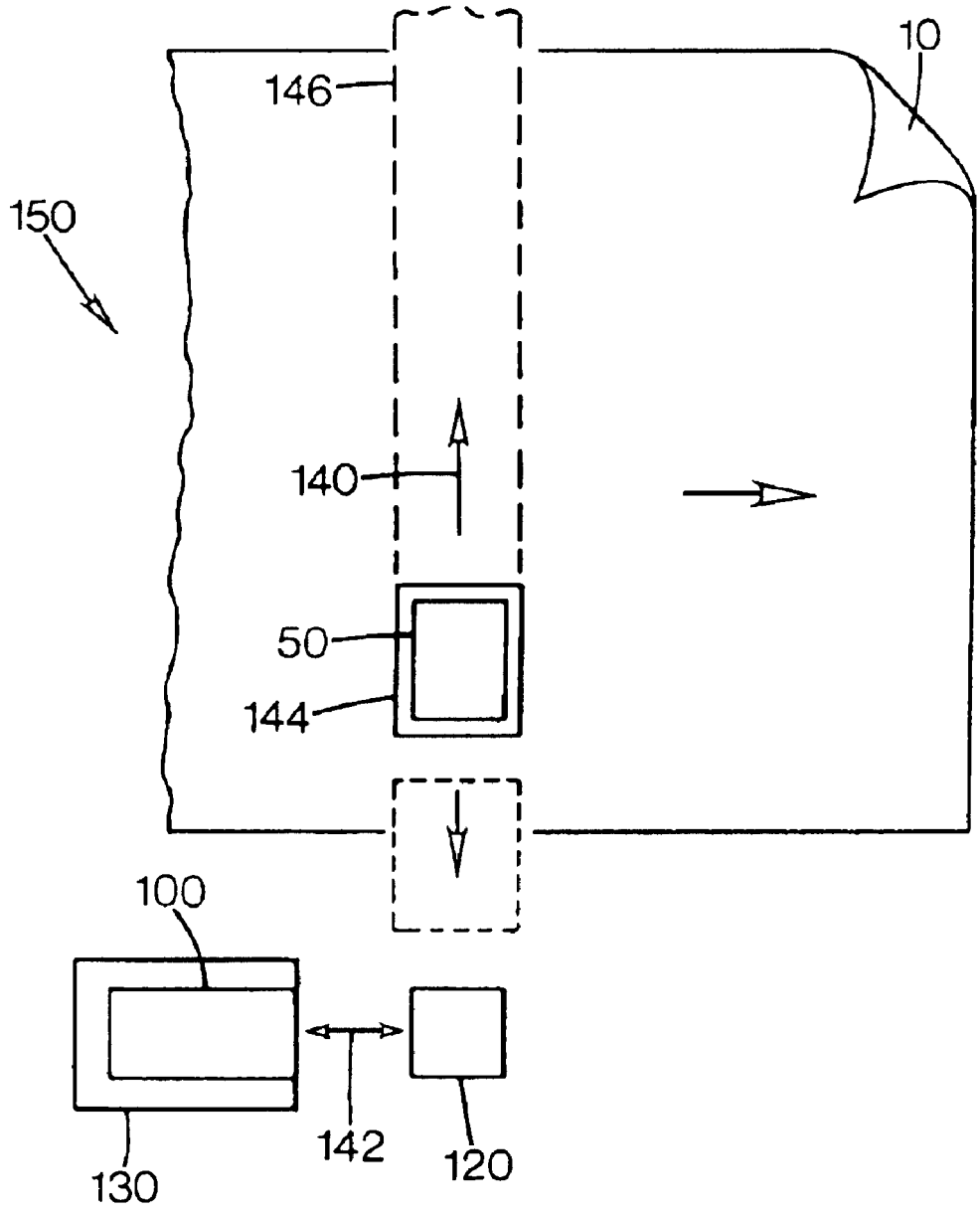
FIG. 4 is a schematic block diagram of an embodiment of a printing system embodying aspects of the invention.

FIG. 4 is a schematic diagram of an inkjet printer 150 embodying aspects of the invention. The PHA unit 50 is mounted in a traversing carriage 144 of the system, which is driven back and forth along a carriage swath axis 140 to print an image on a print medium 10 located at the print zone indicated by phantom outline 146. The fluid supply is mounted on a shuttle 130, in this exemplary embodiment, which is adapted to move the supply 100 along axis 142 from a rest position to a refilling location. After printing, or when required due to a low fluid signal from a printing system drop counter, the PHA 50 is slewed along axis 140 to the designated refilling location in the printer, at which is disposed the pump actuator 120. Then the fluid supply 100 is shuttled toward the PHA 50, causing the fluidic interconnects of each component to mate together, as shown in FIG. 3.

The diaphragm pump 64 is then pressed upwardly via a piston comprising the actuator 120, creating a positive gage pressure buildup in the common chamber 60. The pressure builds until the cracking pressure of the inlet valve 66 is reached; consequently, fluid and accumulated air flows through the valve 66 and channel 70, and onto the capillary material 76. The capillary material 76 acts as a fluid/air separator. This function is achieved by the hydrophilic capillary material absorbing the fluid, but not the air. The air is released into the free space 78 above the capillary material. This space is ventilated via the channel 82 and the labyrinth 84, so the air is allowed to escape to the atmosphere. The fluid that absorbs into the depleted capillary material replenishes the fluid volume in the material, which lowers its back pressure.

Immediately after the pump is pressed, the piston 120 is retracted to allow the pump diaphragm to return to its original shape. This return can be achieved by several techniques. One exemplary technique is to build structure into the shape of the pump, so that the inherent rigidity of the structure will cause it to rebound. Another technique is to use a spring which reacts against the deformation of the piston, returning the pump to its original shape. A diaphragm pump suitable for the purpose is described in co-pending application Ser. No. 10/050,220, filed Jan. 16, 2002, OVERMOLDED ELASTOMERIC DIAPHRAGM PUMP FOR PRESSURIZATION IN INKJET PRINTING SYSTEMS, Louis Barinaga et al., the entire contents of which are incorporated herein by this reference.

During the return stroke of the pump chamber, the back pressure builds in the common chamber. After a certain magnitude of buildup, the recirculation valve 68 cracks open and allows fluid to flow in to the common chamber 60 from the recirculation channel 98 through the plenum 94. The flow of fluid from the recirculation path is limited due to dynamic pressure losses associated with the capillary material (still in a depleted state), stand pipe filter 86, inlet, outlet, recirculation channel, and recirculation valve. Because of this loss, back pressure continues to build in the common chamber 60 due to further return (expanding) of the pump diaphragm. If the back pressure builds high enough, the supply check valve 104 of the fluid supply will crack open, allowing the fluid flow into the common chamber 60 from the fluid supply 100. A pressure balance results between the recirculation flow and the supply inflow.

After the pump 64 returns to its initial position, the piston again cycles the pump. The same steps as described above result from the second cycle, but there is a key difference between successive cycles. As the cycles continue, the capillary material 76 becomes less depleted due to the influx of fluid into the PHA 50 from the supply 100. This reduction in depletion reduces the amount of dynamic pressure loss associated with the capillary material, and the fluid velocity through the fluid channels comprising the recirculation path increases. With the increased fluid flow through the fluid channels comes an increase in fluid channel loss. However, in this exemplary embodiment, the capillary material is selected so that the capillary pressure loss drops more quickly than the fluid channel loss increases. As a result, the pressure loss associated with the recirculation path is reduced in magnitude. This reduction in pressure loss means that the recirculation path becomes more and more capable of fulfilling all of the flow required by the return stroke of the pump. After the desired amount of fluid has entered the PHA, the recirculation path 61 becomes entirely capable of supplying the required return flow, so that the system ceases to ingest fluid from the supply 100. Thenceforth, subsequent pump cycles will only result in additional recirculation because the system has reached pressure equilibrium. At this point, the system is deemed to be at its "set point".

The IDS has the ability to run a recirculation cycle to function as an air purge from the PHA 50. The recirculation air purge cycle functions almost identically to the refilling procedure, except that the PHA 50 is not coupled to the fluid supply 100. Because this cycle is run with the PHA detached from the supply, the recirculation path 61 of the system is isolated as the only source for flow into the common chamber 60.

The air purge procedure consists of recurring cycles of actuating the pump 64, pumping fluid and air from the common chamber 60 onto the capillary material 76 upon contraction of the pump chamber, and then pulling fluid back through the recirculation path 61 upon subsequent expansion of the pump chamber. Air bubbles will accumulate under the inlet valve 66 due to its positioning at the top of the common chamber 60 and the ramped wall of the PHA. Upon each pump inward stroke, the bubbles are expelled along with the fluid into the capillary chamber 74. From the chamber, the air is vented to the atmosphere via the labyrinth 84.

The TAS system includes features that facilitate small sizing of the IDS assembly, and which allows for a very small, multi-colored IDS. The PHA can be fabricated with a relatively small swept volume, and because the fluid supply is located off-axis, the fluid supply volume is not swept. This leads to reduction in printer volume. Moreover, since the IDS does not use tubes to continuously connect between the PHA and the fluid supply, the swept volume and cost of tubes associated with other off-axis designs is eliminated.

This exemplary embodiment of a TAS system is off axis, and requires no tubes. Therefore, no swept volume or routing volume is required to accommodate a tubing component. The TAS nature of the design eliminates the size inefficiency of previous off-axis inkjet designs.

Free fluid supplies are inherently volumetric efficient because no volume is occupied by back pressure mechanisms such as capillary materials like foam. This system eliminates most of the common requirements of the fluid supply, so that the simplified result is basically a box or bag of free fluid.

Reliability Enhancing Techniques

FIG. 5 shows pertinent components of an exemplary embodiment of the printer 150. The printer is an ink-jet printer employing the PHA 50, with a printhead 92 (FIG. 1) comprising multiple nozzles (not shown in FIG. 5). Interface electronics 164 are associated with printer 150 to interface between the control logic components and the electromechanical components of the printer. Interface electronics 164 include, for example, circuits for moving the printhead and paper, and for firing individual nozzles.

Printer 150 includes control logic in the form of a microprocessor 160 and associated memory 162. Microprocessor 160 is programmable in that it reads and serially executes program instructions from memory. Generally, these instructions carry out various control steps and functions that are typical of inkjet printers. In addition, the microprocessor monitors and controls inkjet peak temperatures as explained in more detail below. Alternatively an ASIC or hard-wired logic could be employed in place of the microprocessor. Memory 162 is preferably some combination of ROM, dynamic RAM, and possibly some type of non-volatile and writable memory such as battery-backed memory or flash memory.

A temperature sensor 180 is associated with the printhead 92 on the PHA 50. It is operably connected to supply a printhead temperature measurement to the control logic through interface electronics 164. The temperature sensor in the described embodiment is a thermal sense resistor. It produces an analog signal that is digitized within interface electronics 164 so that it can be read by microprocessor 160. An exemplary temperature sensor is described in further detail in U.S. Pat. No. 6,196,651, entitled "Method and Apparatus for Detecting the End of Life of a Print Cartridge For a Thermal Ink Jet Printer."

Microprocessor 160 is connected to receive instructions and data from a host computer (not shown) through one or more I/O channels or ports 176. I/O channel 176 is a parallel or serial communications port such as used by many printers.

The microprocessor also controls the fluid supply shuttle system 130, the media advance system 170 and the carriage drive system 174, employing sensor signals from the carriage encoder 172.

FIG. 6 shows an exemplary layout of nozzles 92A in one example of a printhead 92. Printhead 92 has one or more laterally spaced nozzle or dot columns. Each nozzle 92A is positioned at a different vertical position, and corresponds to a respective pixel row on the underlying print medium. Of course, other nozzle arrangements could alternatively be employed.

Figure 7:
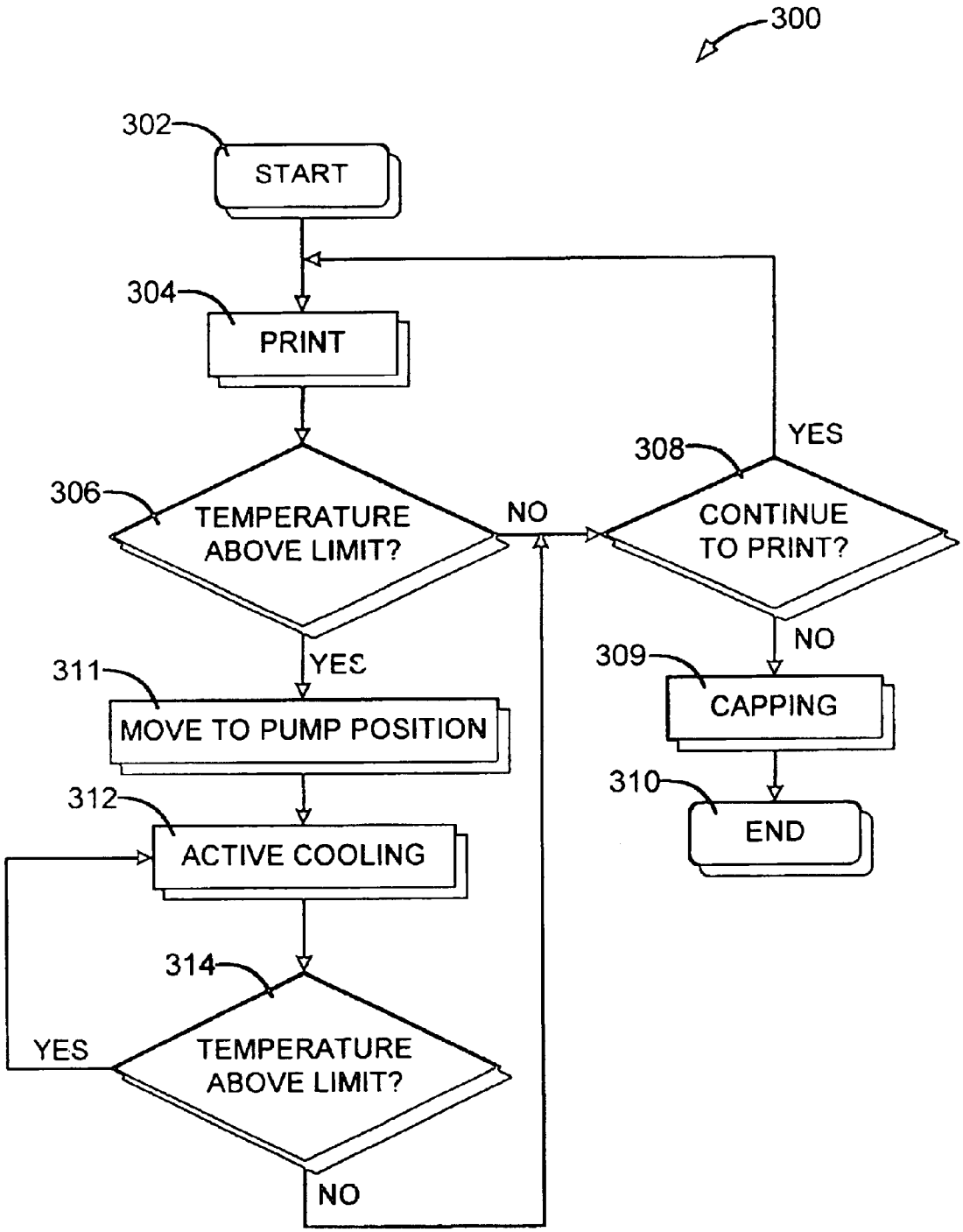
FIG. 7 is a simplified flow diagram illustrative of an embodiment of a heat management algorithm, which utilizes the fluid re-circulation capability of the fluid delivery system of FIGS. 1–6.

FIG. 7 is a simplified flow diagram illustrative of an embodiment of a heat management algorithm 300, which utilizes the fluid re-circulation capability of the PHA 50. The algorithm is started at 302, and a print job is started at 304. The microprocessor 160 monitors the temperature sensed by sensor 180 at 306. If the temperature is not above a limit temperature, typically a predetermined threshold temperature value, the system will decide at 308 to continue with the print job if it has not been finished, or to cap the printhead at 309 and end the algorithm at 310 if the job is completed. If, at 306, the printhead temperature is above the limit value, then the print cartridge is moved to the pump position at 311, and an active cooling process is performed at 312. In a typical system, the cooling process is conducted upon completion of the swath in process, when the carriage is moved to the pump station at which the pump actuator 120 is located. The microprocessor 160 activates the actuator 120 for a series of pump cycles, until the temperature is not above the limit (314), at which point operation proceeds to step 308 to continue to print or end.

Figure 8:
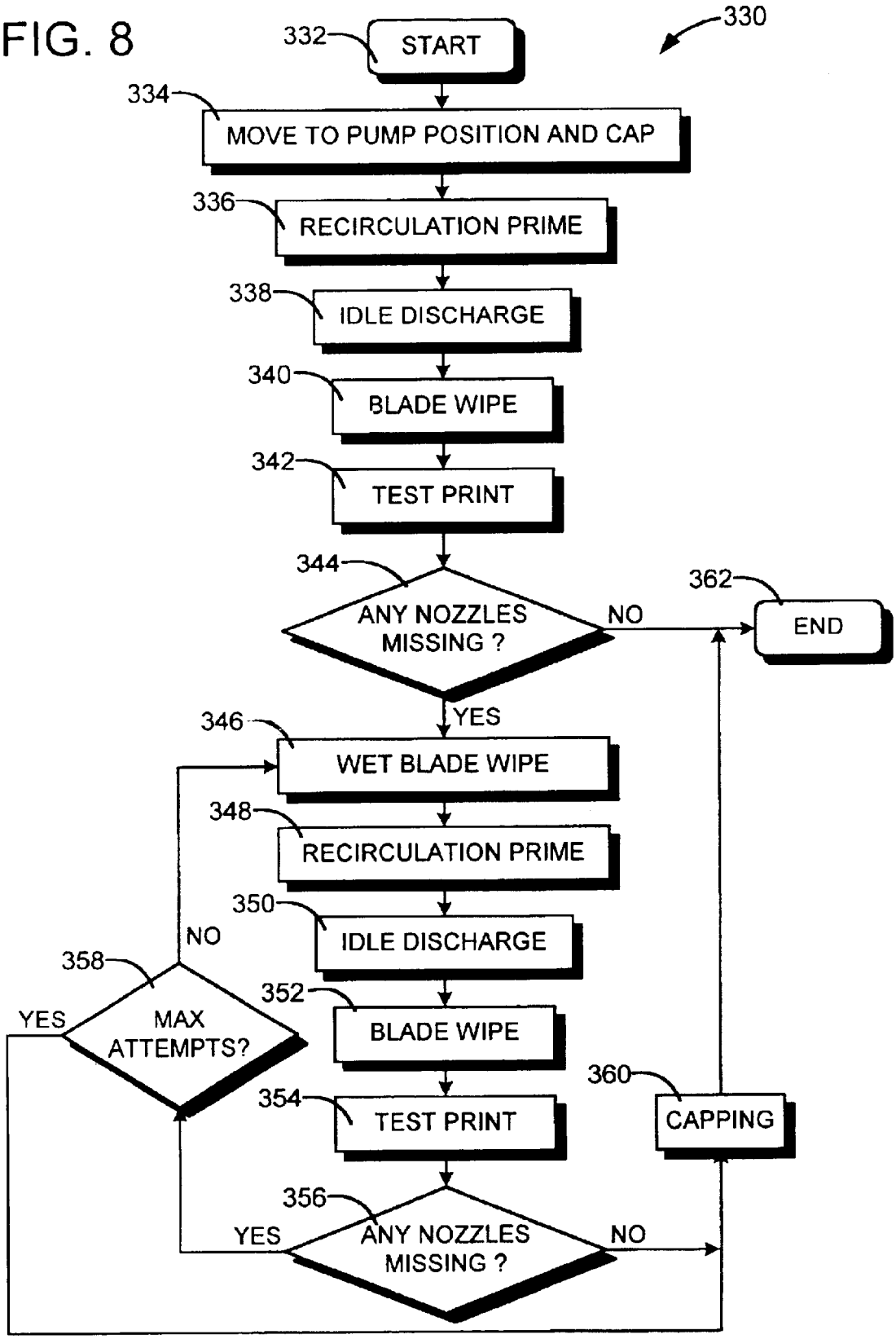
FIG. 8 is a simplified flow diagram of one embodiment of a standpipe priming algorithm which can be carried out by the printing system employing the PHA.

FIG. 8 is a simplified flow diagram of one embodiment of a standpipe priming algorithm 330 which can be carried out by a printing system employing the PHA 50 to achieve in-printer priming of the standpipe or plenum of a new PHA just installed in the printer. In this embodiment, the free ink chamber of the PHA was filled with printing fluid, e.g. ink, prior to shipping, but the fluid standpipe area, the fluid plenum and the printhead nozzles are dry or wetted with a special shipping fluid, e.g. glycerine, when the PHA is shipped from the manufacturer. The algorithm 330 will seek to fill the plenum and prime the nozzle array. The algorithm is started at 332, and at 334, the carriage 144 carrying the PHA is moved to position the PHA at the pump position, and to cap the printhead. A recirculation prime operation is conducted at 336. This operation can be performed with the PHA 50 connected to the fluid supply 100, or it can be performed with the PHA disconnected from the fluid supply. The pump actuator 120 is operated through a sequence of pump cycles. As a result, air will be drawn from the fluid plenum 94, while fluid is drawn from the free fluid chamber 60 through the air-fluid separator 74, the filter 86 and into the plenum.

After a predetermined number of pump cycles, an idle discharge operation 338 (to spit fluid from the nozzles of the printhead 92 into a spittoon) and a blade wipe operation 340 (to wipe the nozzles with a wiper blade) are conducted, a test print is conducted (342), and a detection process (344) is performed to determine whether any nozzles are "missing," i.e. whether it has been detected that any nozzles have failed to print during the test print. Techniques are known in the art for such nozzle detection processes, such as described in U.S. Pat. No. 6,352,331, entitled "Detection of Non-Firing Printhead Nozzles by Optical Scanning of a Test Pattern." Alternatively, this can be done manually, i.e. by visual inspection of a printed test pattern or of a print job by a printer operator to note print quality issues. If no nozzles are missing, the printhead nozzle array is deemed to have been successfully primed, and at 362, the algorithm is ended. If, on the other hand, it is detected that one or more nozzles have failed to print properly, then at 346–352, corrective steps are taken. In this embodiment, a wet blade wipe procedure (346) is performed, wherein a wet blade is used in a wiping of the nozzle array. At 348, a recirculation prime operation is conducted, to pump fluid through the recirculation path. An idle discharge procedure is conducted at 350, wherein the printhead nozzles are fired to eject fluid into a spittoon. Next at 352 another blade wipe procedure is performed. A test print is made at 354, and again a step 356 is undertaken to determine whether any nozzles have failed to eject fluid properly. If no nozzles are detected to have failed, the printhead 92 is capped at 360, and operation proceeds to the end of the algorithm at 362. If nozzles are still missing, then operation returns to 346 to repeat the corrective steps, until a maximum number of unsuccessful attempts has been made (358), when the algorithm will cap the printhead (360) and terminate (362). In the event the prime was unsuccessful, a message may be given to the printer operator to advise of this unsuccessful event.

Figure 9:
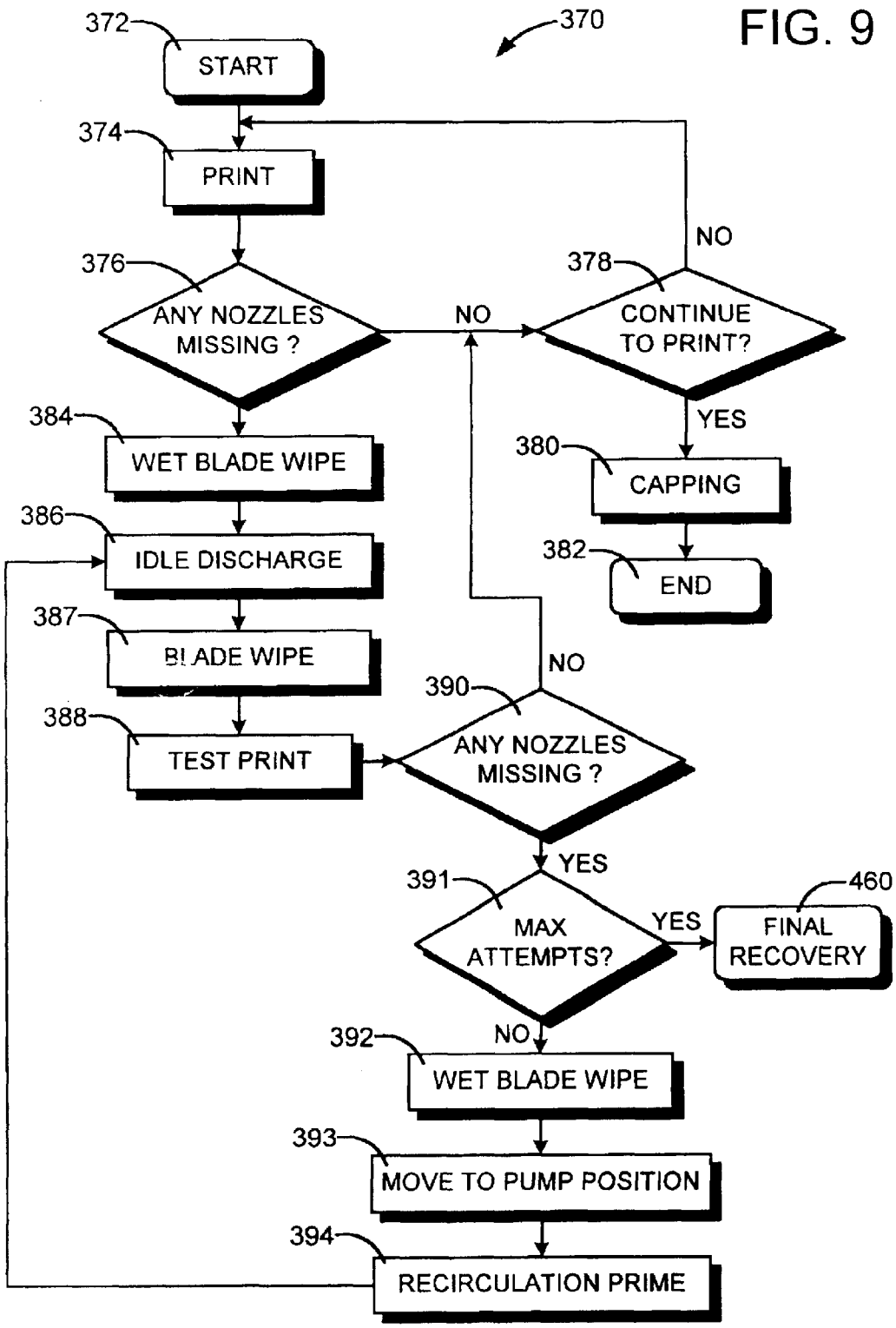
FIG. 9 illustrates an exemplary nozzle reprime algorithm, which monitors printhead nozzle array health during printing operations, and invokes a recirculation process when missing nozzles are detected.

FIG. 9 illustrates a nozzle reprime algorithm 370, which monitors printhead nozzle array health during printing operations, and invokes a recirculation process when missing nozzles are detected. The algorithm commences at 372, a print job is received, and printing commences at 374. Periodically, e.g. at the end of each page of printing the job, or as manually selected by the printer user, a nozzle health check 376 is performed to determine whether any nozzles are missing. If not, then at 378, operation will return to the printing step at 374 if the job is not completed. If the job is completed, then the printhead is capped (380) and the algorithm ends at 382. On the other hand, if at 376 it is detected that one or more nozzles are missing, then initial corrective measures 384–388 are undertaken. At 384, a blade wipe is conducted to wipe the nozzle array. At 386, an idle discharge procedure is performed, followed by another blade wipe procedure 387. A test print is then performed at 388, and if no nozzles are missing (390), operation proceeds to 378. If any nozzles are missing, then, provided a maximum number of attempts have not been made (391), a wet blade wipe (392) is performed, the print cartridge is moved to the pump position (393), and a recirculation prime procedure is conducted at 394. The pump actuator 120 is operated through a sequence of pump cycles. As a result, air will be drawn from the fluid plenum 94, while fluid is drawn from the free fluid chamber 60 through the air-fluid separator, the filter and into the plenum. Operation then loops back to step 386. If a maximum number of attempts to prime have been made at 391, operation proceeds to a final recovery algorithm 460 (FIG. 12), discussed below.

Figure 10:
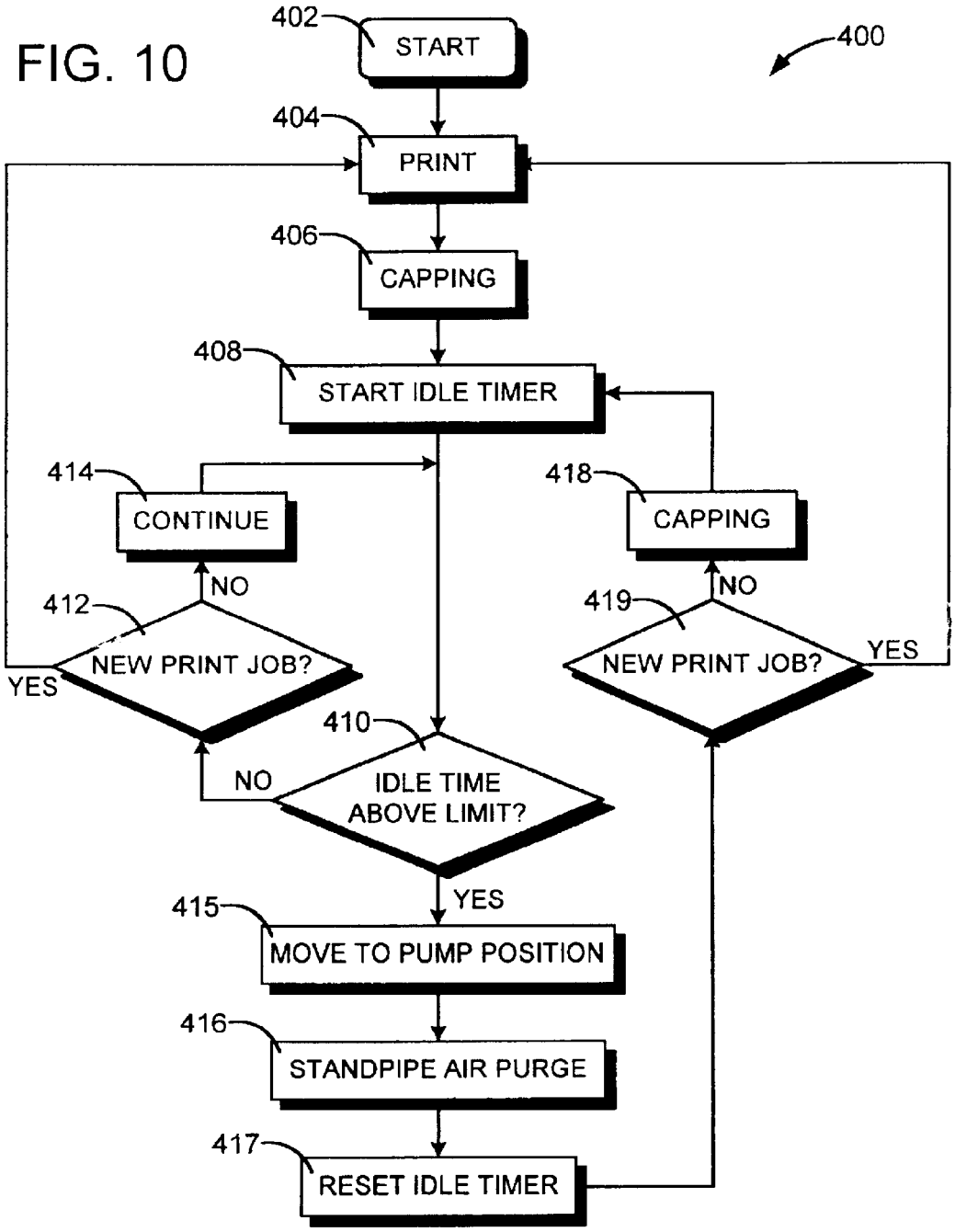
FIG. 10 illustrates an idle time management algorithm, which serves to conduct air purging and fluid recirculation when the time interval since the last print operation exceeds a given limit value.

FIG. 10 illustrates an idle time management algorithm 400, which serves to conduct air purging and fluid recirculation when the time interval since the last print operation exceeds a given limit value, e.g. one week in an exemplary embodiment. The limit value will typically be dependent on the materials selected for PHA construction. Materials with higher air permeability will lead to higher air diffusion rates into the PHA, and thus more frequent air purging will be undertaken, than if materials with lower air permeability are used. The algorithm is entered at 402. A print job is conducted at 404, and the printhead capped at 406. An idle interval timer is started at 408. At decision 410, if the idle time is above a predetermined limit value, the carriage is moved to position the print cartridge at the pump position (415), and a standpipe air purge is performed at 416. The pump actuator 120 is operated through a sequence of pump cycles. As a result, air will be drawn from the fluid plenum 94, while fluid is drawn from the free fluid chamber 60 through the air-fluid separator, the filter and into the plenum. This will not only purge air, but also serve to replace fluid in the passageways with fresh fluid from the free fluid chamber of the PHA, reducing sludge buildup in the narrow fluid passageways of the PHA. At 417, the idle timer is reset, and operation proceeds to decision 419. If a new print job has not been received, the printhead is capped (418) and operation proceeds to 408. If a new print job has been received, operation proceeds to 404 to print. If at 410, the idle time is not above the limit, then the algorithm determines whether a new print job has been received (412), and if so, proceeds to print at 404. If a new print job has not been received, operation continues at 414, and loops back to 410.

Figure 11:
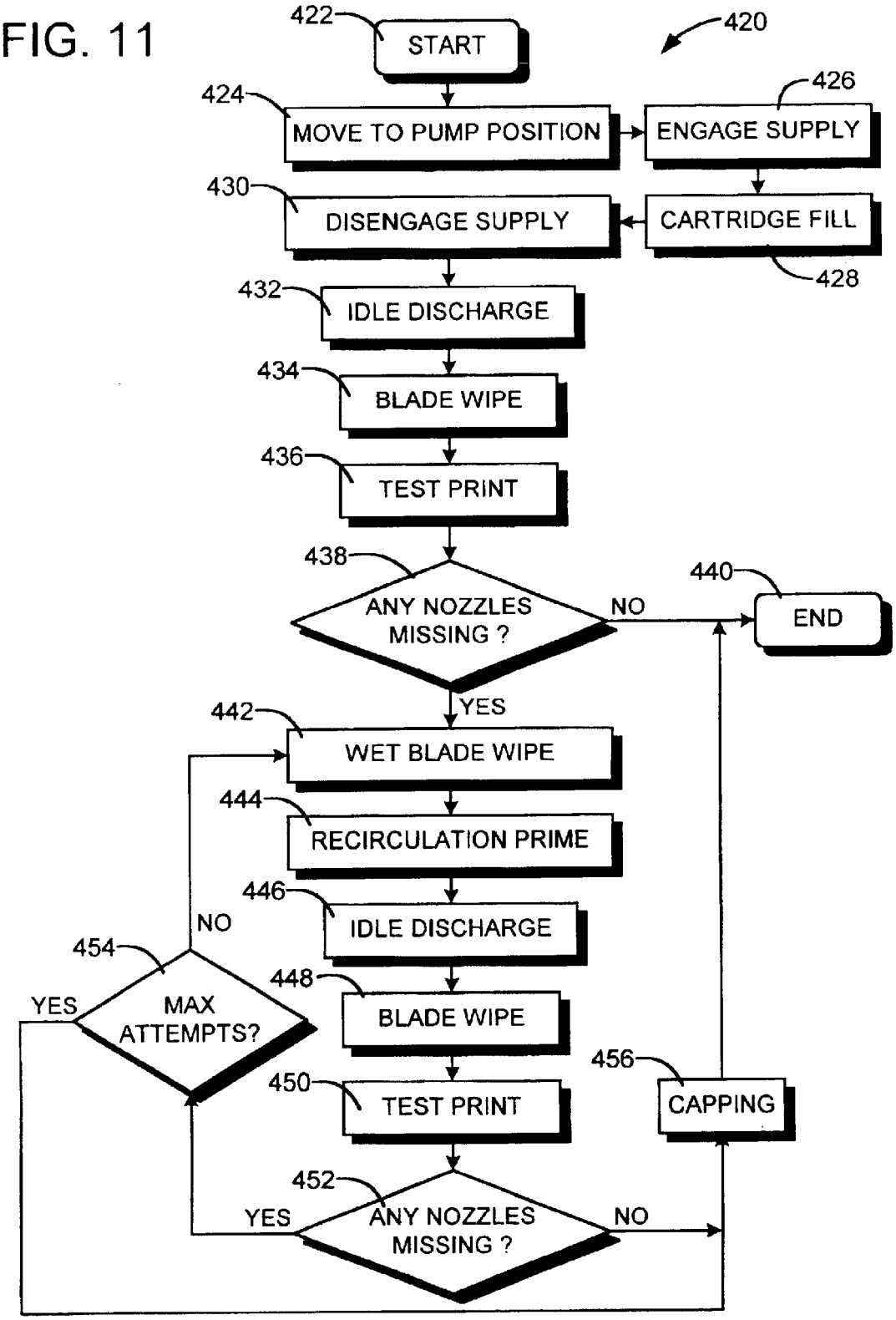
FIG. 11 illustrates an exemplary algorithm for conducting print cartridge filling and standpipe priming.

FIG. 11 illustrates an exemplary algorithm 420 for conducting print cartridge filling and standpipe priming. This algorithm is used for the case in which the fluid supply is intermittently connected to the print cartridge 50. The algorithm starts (422), and at 424, the carriage 144 is moved to position the print cartridge 50 at the pump station. The fluid supply is engaged, making a fluidic connection to the print cartridge (426). At 428, a cartridge fill operation is conducted, wherein the pump is actuated through a series of pump cycles to draw fluid from the supply to the free fluid chamber 60 and the capillary chamber 74. The pumping also circulates fluid through the plenum 94, which is in fluid communication with the nozzles of the printhead. After completion of the cartridge fill operation, the supply is disengaged (430), and an idle discharge operation is conducted to spit fluid from the nozzles (432). A blade wipe procedure (434) is performed, and a test print made (436). At 438, a missing nozzle detection process is performed. If no nozzles are missing, the algorithm ends (440). If missing nozzles are detected, a wet blade wipe (442) is performed, and then a recirculation prime operation is conducted (444). After an idle discharge (446) and blade wipe (448), another test print (450) is made. At detection (452), if no nozzles are missing, the printhead is capped (456), and the algorithm ends (440). If nozzles are missing, then further attempts are made to prime, repeating steps 444–450 until either no nozzles are missing or a maximum number of attempts has been made (454), before capping (456) and ending the algorithm (440).

Figure 12:
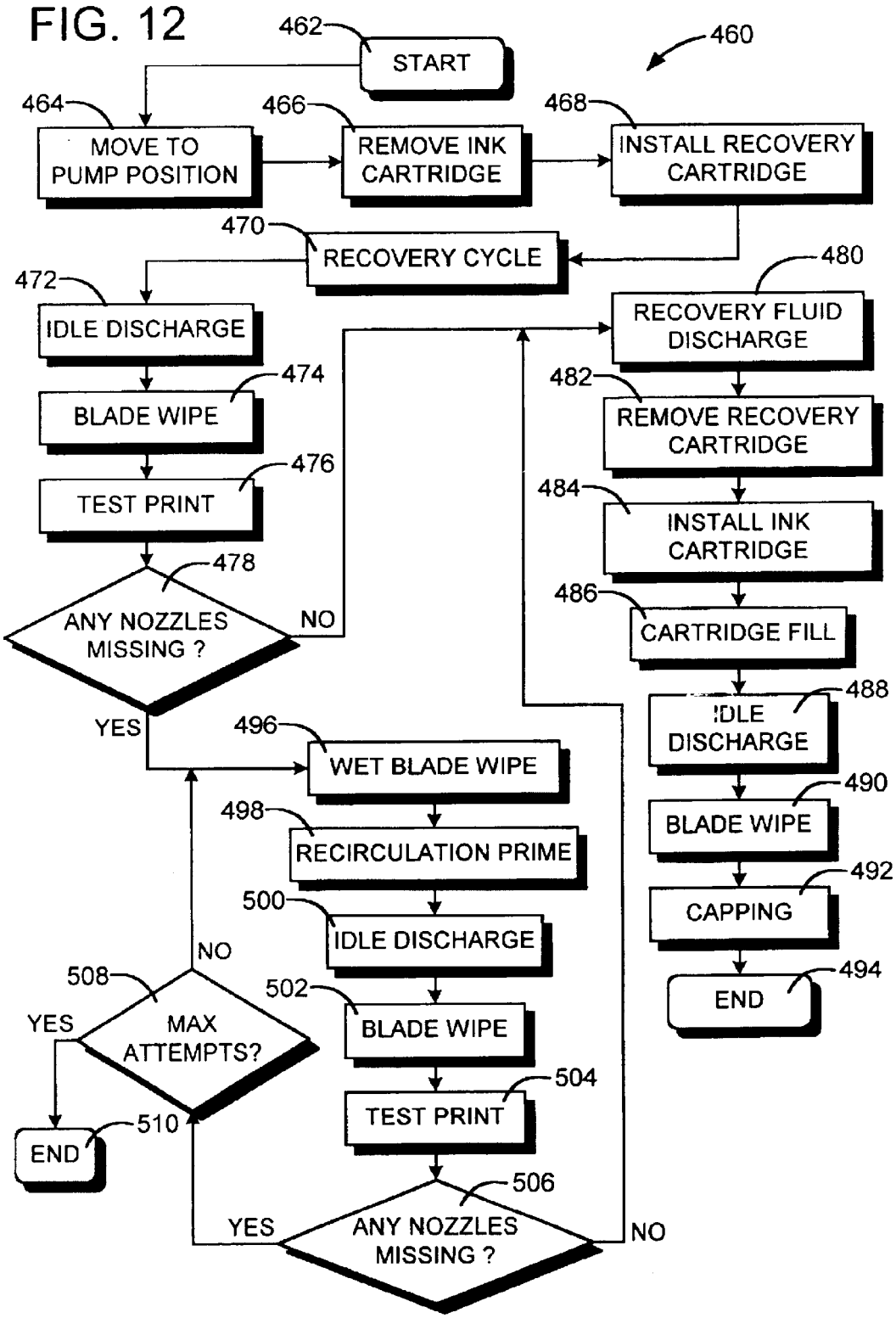
FIG. 12 illustrates an exemplary final recovery algorithm.

FIG. 12 illustrates an exemplary final recovery algorithm 460, which can be invoked from the nozzle reprime algorithm 370 (FIG. 9). After start (462) of the algorithm, the carriage is moved to position the print cartridge at the pump station (464). The printing fluid supply is removed (466), typically containing ink, and replaced with a recovery cartridge (468). The recovery cartridge will contain a recovery fluid with increased solvent load, for example ink formulated with an increased solvent load to increase the fluid's solvent properties for dissolving sludge or particles in the print cartridge. At 470, with the recovery cartridge fluidically connected to the print cartridge, a recovery pump cycle is performed. During the pump cycle, the recovery fluid enters the print cartridge, and is circulated through the fluid paths, to free up deposits such as sludge or particles. The particles will eventually be trapped by the filter 86 or the capillary material, during the fluid recirculation. At 472, an idle discharge process is conducted, and at 474 a blade wipe procedure is performed. A test print is made at 476. If at decision 478, there are no missing nozzles, operation proceeds to a recovery fluid discharge (480), where the recovery fluid is discharged through the printhead into a spittoon or onto a print medium. This discharge step can be omitted, if the recovery fluid is compatible with the printing fluid, and can be used in subsequent printing operations. At 482, the recovery cartridge is removed from the printer and the printing fluid cartridge replaced at 484. A cartridge fill operation is peformed at 486 to replenish the fluid in the cartridge with printing fluid. The recovery fluid in this embodiment is compatible with the printing fluid, and can be employed in subsequent printing operations. At 486, an idle discharge process is performed. After blade wipe (490) and capping (492), the algorithm ends (494). One the other hand, if at 478, missing nozzles are detected, then corrective measures (496–502) are repeated until test prints (504) and nozzle detection (506) indicates there are no missing nozzles, or a maximum number of attempts has been made (508), ending the algorithm (510).

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for recirculating fluid through a print cartridge including a cartridge housing structure and a fluid ejecting structure carried by the housing structure, comprising:

ejecting fluid from the fluid ejecting structure during an operating mode; and pumping fluid through a re-circulation path contained entirely within the housing structure during a pump mode, the path passing through a fluid plenum in fluid communication with the fluid ejecting structure and a fluid reservoir.

2. The method of claim 1, wherein the fluid ejecting structure is a print head having a plurality of nozzles.

3. The method of claim 2, wherein said pumping occurs while the print cartridge is mounted in a printer carriage.

4. The method of claim 3, wherein said pumping comprises:

moving the carriage along a carriage axis to position the print cartridge at a pump station; and actuating a pump actuator mounted on the housing structure to force fluid through the recirculation path.

5. The method of claim 1, wherein the recirculation path passes through at least one check valve allowing one-way flow through the check valve when a valve break pressure is exceeded, and said pumping includes:

creating a fluid pressure sufficient to open the at least one check valve and pass fluid through the at least one check valve.

6. A method for managing heat in a fluid ejecting structure mounted to a housing structure, comprising:

ejecting fluid from the fluid ejecting structure during an operating mode;

pumping fluid through a re-circulation path contained entirely within the housing structure, the path passing through a fluid plenum in fluid communication with the fluid ejecting structure and a fluid reservoir, the fluid plenum and the fluid reservoir contained within the housing structure; and transferring heat from the fluid ejecting structure to fluid re-circulating through the path.

7. The method of claim 6, wherein the fluid ejecting structure is a print head having a plurality of nozzles.

8. The method of claim 7, wherein said pumping occurs while the fluid ejecting structure is mounted in a printer carriage.

9. The method of claim 8, wherein said pumping comprises:

moving the carriage along a carriage axis to position the fluid ejecting structure at a pump station; and actuating a pump actuator mounted on the housing structure to force fluid through the recirculation path.

10. The method of claim 6, wherein the recirculation path passes through at least one check valve allowing one-way flow through the check valve when a valve break pressure is exceeded, and said pumping includes:

creating a fluid pressure sufficient to open the at least one check valve and pass fluid through the at least once check valve.

11. The method of claim 6, further comprising:

sensing a temperature associated with the fluid ejecting structure.

12. The method of claim 11, wherein:

said pumping is performed when said temperature exceeds a threshold temperature value.

13. A method for priming a print cartridge having a housing, a print head, a fluid plenum in fluid communication with the print head, a means for maintaining fluid under negative pressure in said fluid plenum, and an ink reservoir in fluid communication with the fluid plenum, the method comprising:

pumping fluid and air bubbles through a fluid re-circulation path contained entirely within the housing and passing through the plenum and the ink reservoir; and removing the air bubbles from the fluid.

14. The method of claim 13, wherein said fluid reservoir and said plenum are initially depleted of fluid, and further comprising:

passing fluid from a fluid supply external to said print cartridge through an inlet port on the housing during said pumping to fill said reservoir and said plenum with fluid.

15. The method of claim 13, wherein said pumping occurs while the print cartridge is mounted in a printer carriage.

16. The method of claim 15, wherein said pumping comprises:

moving the carriage along a carriage axis to position the print cartridge at a pump station; and actuating a pump actuator mounted on the housing structure to force fluid through the recirculation path.

17. The method of claim 13, wherein the recirculation path passes through at least one check valve allowing one-way flow through the check valve when a valve break pressure is exceeded, and said pumping includes:

creating a fluid pressure sufficient to open the at least one check valve and pass fluid through the at least once check valve.

18. A method of maintaining a print cartridge having a fluid ejecting structure in a printing system, comprising:

monitoring an idle time interval since conducting a print operation for the print cartridge;

conducting a maintenance operation on said print cartridge in response to said monitoring including pumping fluid through a re-circulation path contained entirely within a print cartridge housing structure, the path passing through a fluid plenum in fluid communication with the fluid ejecting structure and a fluid reservoir.

19. The method of claim 18, wherein said pumping occurs while the print cartridge is mounted in a printer carriage.

20. The method of claim 19, wherein said pumping comprises:

moving the carriage along a carriage axis to position the print cartridge at a pump station; and actuating a pump actuator mounted on the housing structure to force fluid through the recirculation path.

21. The method of claim 18, wherein the recirculation path passes through at least one check valve allowing one-way flow through the check valve when a valve break pressure is exceeded, and said pumping includes:

creating a fluid pressure sufficient to open the at least one check valve and pass fluid through the at least once check valve.

22. The method of claim 18, wherein the fluid is a liquid ink using in printing operations.

23. The method of claim 18, wherein the fluid is a cleaning fluid not used during normal printing operations.

24. A method of maintaining a print cartridge in a printing system, the print cartridge including a housing structure and a fluid ejecting structure carried by the housing structure, comprising:

conducting a maintenance operation on said print cartridge, including pumping fluid through a re-circulation path contained entirely within the housing structure, the path passing through a fluid plenum in fluid communication with the fluid ejecting structure and a fluid reservoir; and as fluid is pumped through the re-circulation path, passing the fluid through a filter to trap particulate contamination.

25. The method of claim 24, wherein said pumping occurs while the print cartridge is mounted in a printer carriage.

26. The method of claim 24, wherein said pumping comprises:

moving the carriage along a carriage axis to position the print cartridge at a pump station; and actuating a pump actuator mounted on the housing structure to force fluid through the recirculation path.

27. The method of claim 24 wherein the recirculation path passes through at least one check valve allowing one-way flow through the check valve when a valve break pressure is exceeded, and said pumping includes:

creating a fluid pressure sufficient to open the at least one check valve and pass fluid through the at least once check valve.

28. The method of claim 24, wherein the fluid is a liquid ink using in printing operations.

29. The method of claim 24, wherein the fluid is a cleaning fluid not used during normal printing operations.

* * * * *